US006256973B1

(12) United States Patent
Langen

(10) Patent No.: US 6,256,973 B1
(45) **Date of Patent: *Jul. 10, 2001**

(54) TRANSPORTING AND STORAGE SYSTEM FOR SPINNING CANS

(76) Inventor: Manfred Langen, Schulstrasse 58, D-41065, Moenchengladbach (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/053,990

(22) Filed: Apr. 2, 1998

(30) Foreign Application Priority Data

Apr. 4, 1997 (DE) ..... 197 13 859

(51) Int. Cl.[7] ..... D01H 9/10
(52) U.S. Cl. ..... 57/281; 57/90; 19/159 A
(58) Field of Search ..... 57/90, 281, 268; 19/159 A; 414/222.01, 222.13

(56) References Cited

U.S. PATENT DOCUMENTS

| | | | | |
|---|---|---|---|---|
| 4,012,893 | * | 3/1977 | Weber | 19/159 A |
| 4,735,040 | * | 4/1988 | Pircher | 57/281 |
| 5,138,828 | * | 8/1992 | Stahlecker | 57/281 |
| 5,257,897 | * | 11/1993 | Yamamoto et al. | 57/281 |
| 5,276,947 | * | 1/1994 | Fritschi et al. | 57/281 |
| 5,297,317 | * | 3/1994 | Liefeld et al. | 19/159 A |
| 5,311,645 | * | 5/1994 | Schwalm et al. | 19/159 A |
| 5,500,986 | * | 3/1996 | Leifeld et al. | 57/281 |
| 5,632,138 | * | 5/1997 | Leidgens | 57/281 |
| 5,992,136 | * | 11/1999 | Langen | 57/281 |

FOREIGN PATENT DOCUMENTS

| | | | |
|---|---|---|---|
| 94 21 084 U | | 4/1995 | (DE) . |
| 44 29254A1 | | 2/1996 | (DE) . |
| 0 371 417 | | 11/1989 | (EP) . |
| 0 508 365 | | 4/1992 | (EP) . |
| 0371391A1 | | 11/1996 | (EP) . |
| 4118429 | * | 1/1992 | (JP) ..... 57/281 |

* cited by examiner

*Primary Examiner*—John J. Calvert
*Assistant Examiner*—Gary L. Welch
(74) *Attorney, Agent, or Firm*—Kennedy Covington Lobdell & Hickman, LLP

(57) ABSTRACT

A transporting and storage system for spinning machines is described, whose object is to achieve supply between machines that fill spinning cans and machines that empty spinning cans with the least possible loss in terms of travel distances and utility. According to the invention, the can distribution from the machine that fills the spinning cans to the removal can storage area before the machine that empties the spinning cans is maintained unchanged. Between the two machines, preferably three types of can storage areas are provided, namely a storage area to be filled with full cans following the first machine, a main storage area for absorbing production fluctuations between the first and second machines, and a removal storage area for the second machine. In the first storage area, there must always be empty cans, while in the third storage area there must always be full cans, so that no down times of the machines for lack of cans will occur.

28 Claims, 1 Drawing Sheet

25
24
23
26
21
19
15
25
28
13
18
22
26
21
19
16
29
2
2'
14
3
4
5
27
17
1
6
12
10

TRANSPORTING AND STORAGE SYSTEM FOR SPINNING CANS

FIELD OF THE INVENTION

The invention relates to a transporting and storage system for rectangular spinning cans with can storage areas and can conveyors between first machines, such as drawframes, which fill empty spinning cans and second machines, such as open-end spinning machines or flyers or jet spinning machines, which empty full spinning cans.

BACKGROUND OF THE INVENTION

In a large spinning machine operation, which for instance includes many drawframe machines followed by open-end spinning machines, or many flyers and jet spinning machines that follow the drawframes, the goal is to keep at least those spinning machines that function substantially automatically producing uninterruptedly, day and night. The prerequisite is that the spinning machines be supplied continuously with sufficient preliminary material, that is, full spinning cans. Since the degree of automation in these systems, which can begin with the opening of a bale of fibers shipped as raw material, has not yet been as advanced as that of the actual spinning mill, the attempt is made to prepare and store the preliminary material during the day or during the working week in such a great amount that the actual spinning mill can keep operating during the night and on weekends without interruption.

OBJECT AND SUMMARY OF THE INVENTION

The object of the invention is to create an automatic supply of full cans between the first and second machines or systems, without any, or with the least possible, loss in terms of both travel distance and utility caused by the transporting and storage system.

The invention relates to a transporting and storage system for spinning cans overall. The system encompasses the region of a spinning mill between the can outlet from the drawframes and the can inlet to the spinning machines. In the open-end or jet spinning mill, the spinning machines directly follow the drawframes, optionally via an intervening can storage area. In the ring spinning mill, generally at least one flyer stage is placed between the drawframe and the spinning machines.

By means of the invention, a transporting and storage system for spinning machines is created, whose object is to achieve supply between machines that fill spinning cans and machines that empty spinning cans with the least possible loss in terms of travel distance and utility. According to the invention, the can distribution from the machine that fills the spinning cans to the storage areas before the machine that empties the spinning cans is maintained unchanged. Between the two machines, preferably three types of storage areas are provided, namely a storage area to be filled with full cans following the first machine, a main storage area for absorbing production fluctuations between the first and second machine, and a removal storage area for the second machine. In the third storage area, there must always be empty cans, while in the first storage area there must always be full cans, so that no down times of the machines for lack of cans will occur.

The transporting and storage system of the invention preferably has substantially the following components:

a) Drawframe storage area.

At the can filling position of a drawframe machine (or flyer), spinning cams (empty cans) are filled and placed in the drawframe can storage area or the first can storage area. The drawframe can storage area contains at least one empty can and at least storage space for full cans. The cans are each setup in order, side by side, in uniform multi-can groups, such as groups of four, groups with only empty cans, or groups with only full cans. The drawframe can storage area may preferably comprise a row of individual storage spaces located side by side. On one end of this storage row, the empty cans are brought in groups, for instance with the aid of a can conveyor (drawframe displacement carriage), and on the other end of the row, the full cans are taken away, preferably in groups of the same size as the empty cans and with the same drawframe displacement carriage.

b) Drawframe displacement carriage.

The drawframe displacement carriage or first can conveyor can hold from one to n, preferably four, empty cans or full cans, and can thus supply the drawframe can storage area with groups of empty cans and can take groups of full cans away from the drawframe can storage area. Optionally, the drawframe displacement carriage retrieves empty cans from a downstream can storage area and brings groups, preferably of the same size, of full cans to that can storage area.

c) Second can storage area.

The second can storage area according to the invention comprises at least one can conveyor system for empty cans and at least one can conveyor system for full cans. Each of these can conveyor systems should be capable of transporting a row of a plurality of can groups standing in line with one another in some way from one end (back end) of the area to the other end (head end) of the area.

The can conveyor systems may hold from one to n cans side by side, with n preferably being the same size as in the drawframe displacement carriage, and a plurality of such can groups in line with one another. If more than two can conveyor systems are provided in the storage area, then they can selectively hold empty cans or full cans. In each can conveyor system, that is, in each row of cans, the cans are delivered in groups from the drawframe can storage area at the end of the row and removed again from the other longitudinal end of the row, that is, the head of the row, expediently in groups of the same size in each case. Transportation within the respective row is preferably done with the aid of a conveyor means disposed in the bottom of the storage area of each row, which allows advancement of the row of cans, preferably up to a defined position at the head of the row. For removal of the groups of cans at the respective head of the row, a storage displacement carriage is provided.

d) Storage displacement carriage.

The storage displacement carriage or second can conveyor represents a connecting member between the aforementioned storage second can storage area and a downstream machine or a third can storage area. The storage displacement carriage should be embodied according to the invention such that it can hold a group of from 1 to n empty cans, or an equal-sized group of full cans, and preferably once again n=4 (as in the case of the drawframe displacement carriage and the second can storage area). Optionally, it takes empty cans from whatever system follows it and takes these cans to the second can storage area. The storage displacement carriage retrieves an equal-sized group of full cans from the second can storage area and delivers these cans to a receiving position in the downstream machine.

e) Machine storage area.

Within the scope of the invention, each of the two machines may be assigned a third or machine can storage area. This storage area should have a larger number m (preferably m=n+2) of can parking places or storage spaces than what one of the aforementioned displacement carriages, especially the storage displacement carriage, can hold. The result attained is that in the machine can storage area, at least one full can is always ready for replacing a can that has run empty at a spindle. In principle, in this last- named machine can storage area, however, a larger storage space may also be furnished, so that any possible emergency situations will be covered.

f) Can changing carriage.

To supply the respective second machine, a third can conveyor or can changing carriage may be provided. It should preferably be capable of bringing from 1 to h (preferably h is at most equal to n) empty cans to the machine can storage area (third can storage area) and to retrieve the same number of full cans from there. The can changing carriage retrieves and brings only so many full cans and empty cans as it still has a free place for, however. This is advantageous if the cans are in closed rows next to one another below the work positions or spindles of the respective spinning machines (it is equally possible also for the cans to be oriented in the machine can storage area, especially if this increases the reserve capacity). If one of these cans standing under the spindles is empty, then the can changing carriage first takes the empty cans to its empty parking place and pushes a full can into the place at the spindle. Once the can changing carriage no longer contains any full cans, it drives to the machine can storage area and replaces the empty cans it holds with full cans.

By means of the system embodiment of the invention, it is attained that from 1 to n empty cans are always present in the first can storage area or drawframe can storage area, so that the preceding machine (drawframe) cannot come to a stop from a lack of empty cans. The following second can storage area absorbs production fluctuations between the first machine and the second machine. In the third can storage area or machine can storage area that is preferably also present, full cans should always be present, preferably at least as many as the can changing carriage (third can conveyor) can hold, so that the can changing carriage can supply the downstream machine with full cans without any waiting.

Within the scope of the invention, it may be favorable for reasons of space or economy to embody the first and second can conveyors and in particular the third can conveyor as well technically identically. If the first or second can conveyor is omitted or fails, then if suitable drive tracks have been prepared, the remaining can conveyor can form the connecting member between the first and second can storage areas, and optionally also between the second and third can storage areas.

In principle—in a small spinning mill—it may also be appropriate to embody one can conveyor and equip it with travel routes such that it is constantly capable of performing the tasks of either of the first two can conveyors or all three can conveyors. The third can conveyor, however, can be used only conditionally for the tasks of the first and second can conveyors. In its typical function, the can conveyor in fact changes the cans at the spinning machine and in the machine storage area, one at a time, successively. In an instance of atypical use (that is, as a first or second can conveyor), it is therefore desirable to switch the third can conveyor over so that it can give up or hold at least two cans at a time each.

Depending on the intended function and the size of the spinning mill, it may also be advantageous to omit the third can storage area or machine can storage area and the third can conveyor or storage displacement carriage entirely. In that case, the can changing carriage (third can conveyor) retrieves four cans directly from the can storage area (second can storage area) and brings empty cans back to it.

If major production fluctuations in the goods preceding the second machines have to be compensated for, for instance, or if different roving yarns have to be processed on a second machine, then it may be advantageous within the scope of the invention, in addition to or instead of the third can reservoir or machine can storage area, to provide a fourth can storage area or supplementary can storage area directly on the respective second machine, for instance on its longitudinal end between the drive track of the third can conveyor (can changing carriage) and the machine. The supplementary spaces in the supplementary can storage area may be arranged in similar groups as in the third can storage area, or else the additional can spaces may join the respective row of cans (at the machine head) that have just now run empty in the machine. In this way, at every machine, the cans to be processed there can be furnished directly, so that can changing can be done relatively quickly and in quick succession.

The loss of utility at the spinning mill machine is reduced to a minimum, according to the invention. One advantage in manipulation of the system according to the invention is also that the can distribution is to be kept unchanged from the first to the last can storage area in the system, so that as needed more cans at a time, preferably four each, will be transported in the same group everywhere or continuously.

Another advantage of the system of the invention is unexpectedly obtained because of the conveyor systems of the can storage area that are disposed between the first and second machine group in each case. Here the cans are transported in rows of a plurality of can groups in line with one another each, from the direction of the preceding system to the direction of the following system, in each case with removal of one can group at the head end and the addition of one can group at the rear end. The respective conveyor system may for instance hold six groups, each of four cans, in line with one another. Along the conveying route, the cans can be lifted or lowered to a certain extent, by inclining the route, for instance by 10 to 50 cm. This surprisingly makes it possible to achieve a height compensation of the can positions of the preceding machine with the can position of the following machine without additional hoisting means. If the cans in a drawframe machine are positioned somewhat higher than in a spinning machine (or vice versa), then the transfer of the cans can be done practically imperceptibly, with the aid of the transporting and storage system of the invention.

The system according to the invention is a fully automatic association between the first and second machines. Because of the systematics described, the system is characterized by great flexibility. It enables a flexible association between the first and second machines, and in conjunction with the allocation of the can storage area, it can be adapted suitably to the demand or consumption of cans at any time. This is advantageous, since depending on the material being produced, the demand can fluctuate very greatly. The system according to the invention makes it possible to keep the time-specific can reserve for each material approximately the same and thus to optimize the use of both workers and machines.

The great flexibility of the overall system according to the invention is also exhibited in the fact that in an extreme case, for instance, any "extremely outermost" first machine can be associated with any "outermost" second machine with an arbitrary proportion of storage space. Preferably, however, the machines of the first and second group facing one another "straight ahead" are associated with one another via the proportion of the storage area located directly between them. Then the travel routes for the drawframe displacement carriages and storage displacement carriages become as short as possible, and the output becomes correspondingly high.

If in large systems an extremely high output is demanded, then a plurality of drawframe displacement carriages and storage displacement carriages can be used. In that case, preferably the first and second machines are divided into groups in accordance with the respective numbers of displacement carriages. So that the same can outputs will be obtained in each group, the groups may also be of different sizes.

It is especially advantageous that the system of the invention can be adapted in every respect to suit demand. For instance, if an extremely high can demand is required at one or more second machines, then at this machine or these machines one additional can changing carriage each can be used. The output of this machine or machines can be greatly increased as a result, for instance by nearly 100%. When the invention is employed, the loss of utility is on the order of one-tenth, compared with a conventional manual or previously known automatic system of average can demand.

A further indicator of the high flexibility and adaptability of the system of the invention is that any conceivable configuration can be served with only four basic components, namely the displacement carriage (especially the storage displacement carriage), the second can storage area, the machine can storage area, and the can changing carriage.

If for whatever reason the second machines are for instance in two rows or at right angles to the first machines, then merely a simple conveying technique suffices to connect these basic components three-dimensionally.

The can conveyor carriages can be operated in the conventional way. If the can changing carriage is battery operated, as preferred, then the battery capacity and its charge cycle should be adapted, and the arrangement designed in such a way that this can be done at the machine can storage area during operation or a stop at that location.

Each of the aforementioned four basic components may be equipped with an independent controller and thus, for instance for maintenance and repair, be taken out of the entire controller system and reinserted into it without difficulty. Furthermore, by means of these individual controllers, the individual components can have command input manually. In particular, the first machines with the drawframe reservoir should each have their own controller or should be centrally combined separately in terms of control. The same is true for the second machines, and so forth.

In addition, a central controller for the entire system of the invention can be provided. From the first machines, for instance, the central controller requires the information as to which machine has four filled cans. The overall controller is told by the controller of the second machines, for instance, which can is empty at which machine, or which can will become empty within a predictable time.

The only manual operations to be done by the operating employees are essentially the storage allocations. All the other processes are handled and administered by the overall system controller independently. Also at this overall system controller, the respective operating state is indicated, such as the degree to which the storage reservoir is filled with which material. This enables immediate adaptation to new conditions.

BRIEF DESCRIPTION OF THE DRAWINGS

Preferred embodiments of the present invention will now be described in detail with reference to the accompanying drawings, wherein.

DETAILED DESCRIPTION OF PREFERRED EMBODIMENTS

Figures 1, 2:
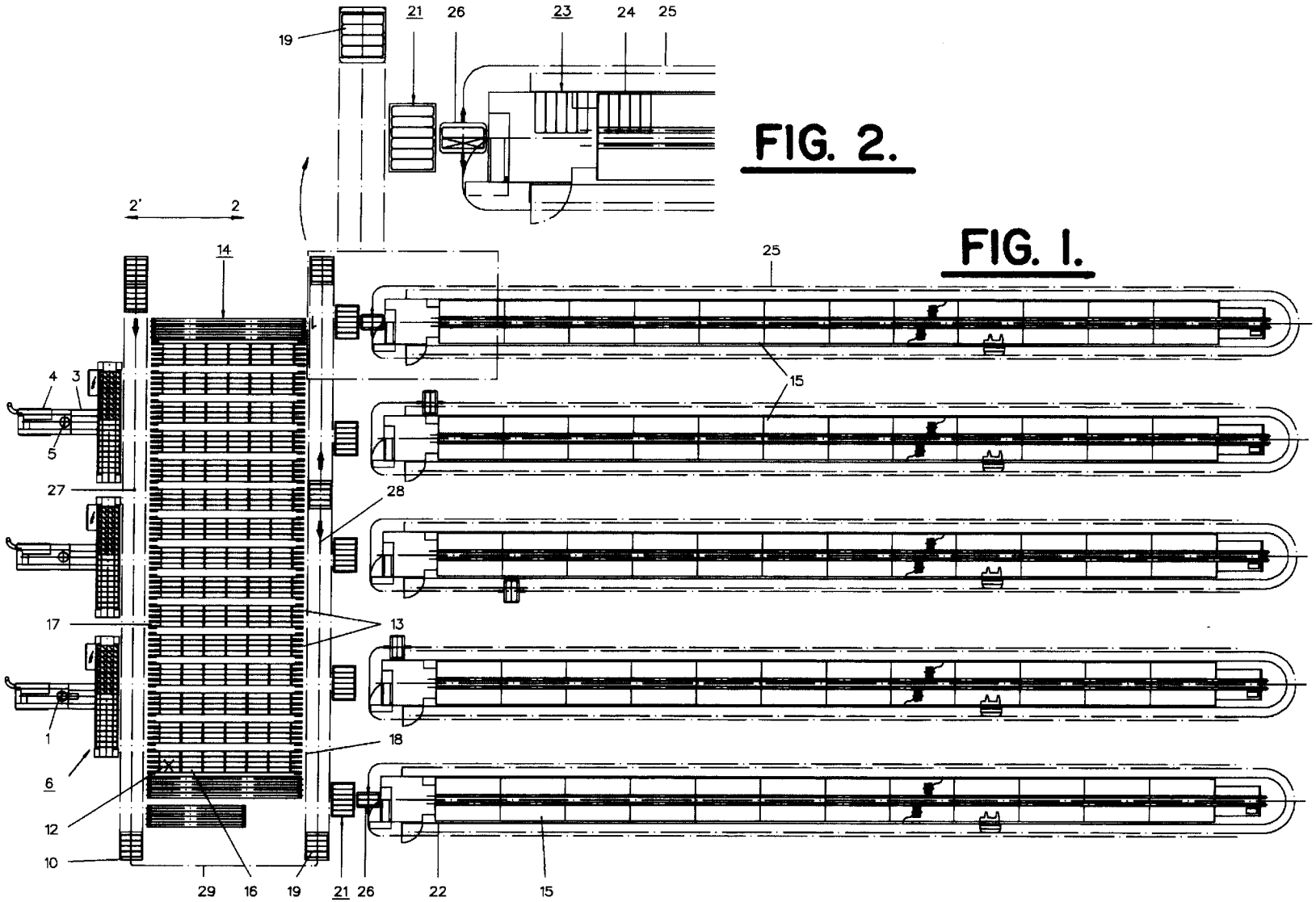
FIG. 1 schematically illustrates a first preferred embodiment of the invention.
FIG. 2 schematically illustrates a second preferred embodiment of the invention.

Referring to the figures the system of preferred embodiments of the present invention, transport cans 1 are transported according to the invention in the transporting direction 2. In the FIG. 1, transporting begins at the outlet 3 from the respective drawframe machine 4. At its can filling position 5, the individual can 1 is filled with drawn roving. Once a can 1 is full, it is pushed into a first can storage area, the so-called drawframe can storage area 6. To that end, the drawframe can storage area 6 should have at least one empty space or a few empty spaces 7, but should also contain several empty cans 8, so that after the respective full can 9 has been carried away, an empty can 8 can be brought to the can filling position 5 as immediately as possible. In each case, the empty cans 8 and the full cans 9 in the drawframe can storage area 6 should each be positioned or collected in order, side by side, in respective groups.

For bringing empty cans 8 to the drawframe can storage area 6 and for carrying away the full cans 9 collected there, according to the invention a first can conveyor or drawframe displacement carriage 10 is used. This carriage should have a storage capacity of cans so that at the same time it can hold one group of empty cans or full cans at a time. Once such can group 11 may preferably include four cans. However, other numbers, such as 3–6 cans, can advantageously be considered as well. The number of cans per can group 11 is determined by commercial factors and depends on the capacity of the overall system.

According to the invention, the drawframe displacement carriage 10 is utilized for taking one can group 11 of full cans 9 out of the drawframe can storage area 6 and bringing it to a free space 12 in a row 13 of a second can storage area 14, and conversely bringing a group 11 of empty cans out of the can storage area 14 to the drawframe can storage area 6. According to the invention, the can storage area 14 between the first machines or drawframe machines 4 and second machines or spinning machines 15 should have at least one can conveyor system 16 with a capacity for holding one row 13 of can groups 11 of empty cans 8 each and at least one can conveyor system 16 for holding one row 13 of groups 11 of full cans 9 each.

In each can conveyor system 16, the can groups 11 coming from the drawframe can storage area 6 are set down on the rear end 17 with the aid of the drawframe displacement carriage 10 and are then transported by a conveyor system in the transporting direction 2 to the head end 18, preferably up to a defined position at which the downstream means can securely engage them, and there they are held ready for removal by a further can conveyor. Since each can conveyor system 16 has a significant length in the transporting direction 2, an example being that six can groups follow one another in each row 13, the conveyor system is capable of raising or lowering the cans to a certain extent in the transporting direction 2 for height compensation between successive machines.

From the storage area 14, the cans are in turn carried onward, preferably in the same can groups 11, with the aid of a second can conveyor or storage displacement carriage 19; the storage displacement carriage 19 takes groups of full cans 9 out of the individual rows 13 of the can storage area 14 and puts empty cans down there, again in groups 11. The transporting of the rows of empty cans is done in the can storage area 14 in the opposite direction 2' from the general transporting direction 2 of the rows of full cans.

In the preferred embodiment, with the aid of the storage displacement carriage 19, in general after empty cans have been retrieved from the machine can storage area 21, full cans are expediently transferred, again in can groups 11, to a third machine can storage area 21. While in the can storage area 14, or its rows 13, preferably from row to row, cans with roving of different quality can be produced, intended for different machines or spindles in these machines 15, the intent is that in the machine can storage area 21, the roving yarns to be processed directly on the associated machine should be furnished. Each of the machine can storage areas 21 should be equipped with more storage spaces for cans than the storage displacement carriage 19 is capable of transporting at once. In this way, it is attained that the machine can storage area 21 always keeps at least one full can ready for exchange at a spindle of the associated spinning machine 15. Preferably, however, at least two cans more than are in one can group 11 should always be present in the machine storage area.

As shown by the enlarged detail in the drawing, space can be created at the head 22 of the respective spinning machine 15 for a supplementary can storage area 23. In the supplementary area 23, the cans should be positioned, as shown, in the form of a virtual continuation of the row 24 of cans leaving the spindles of the spinning machine 15. Alternatively, however, the cans in the supplementary can storage area 23 may also be arranged crosswise to the row 24 of cans, as in the machine can storage area 21. The special feature of the supplementary can storage area 23 is also that it is located within the drive track 25 of a third can conveyor, or can changing carriage 26, that drives around the respective spinning machine 15. The can changing carriage 26 should have at least two storage spaces for cans. In operation, one of the changing spaces of the can changing carriage should be always kept available, so that by means of the carriage, when cans that have run out at a spindle are exchanged, these cans can be pulled onto the empty space in the carriage and replaced with a full can that has been brought on the same carriage.

In general it suffices if the drawframe displacement carriage 10 and the storage displacement carriage 19 have driving routes 27 and 28 that are independent of one another. In individual cases, however, it may be favorable to couple the driving routes 27 and 28 by means of a connecting track 29, so that one and the same carriage 10 or 19, especially if the carriages are embodied technically identically, will be suitable for both transporting tasks.

Finally, not only the storage displacement carriage 19 but also the machine reservoir 21 may be omitted, for instance for reasons of space, capacity or cost. In that case, the can changing carriage 26 retrieves full cans from the can storage area 14 and brings empty cans back to that storage area as shown in FIG. 2.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An arrangement for transporting and storing spinning cans between a first machine which fills empty spinning cans and a second machine which empties filled spinning cans, comprising:

a) a first can storage area disposed adjacent the first machine;

b) a second can storage area including, i) a first can conveyor extending between a rear end and a head end of said second can storage area for transport of a filled can only from said rear end to said head end, and ii) a second can conveyor extending between said head end and said rear end of said second can storage area for transport of an empty can only from said head end to said rear end;

c) a first can displacement carriage movable between said first can storage area and said second can storage area for transporting filled cans from said first can storage area to said second can storage area at said rear end thereof, and for transporting empty cans from said second can storage area at said rear end thereof to said first can storage area; and d) another carriage movable between said second can storage area and the second machine for transporting filled cans from said second can storage area at said head end thereof to the second machine, and for transporting empty cans from the second machine to said second can storage area at said head end thereof.

2. The arrangement of claim 1, wherein said second storage area comprises a plurality of parallel first said conveyors of said second can storage area extending between said rear end and said head end of said second can storage area for transport of filled cans from said rear end to said head end, and a second plurality of parallel second said conveyors of said second can storage area also extending between said head end and said rear end of said second can storage area for transport of empty cans from said head end to said rear end, said first can displacement carriage being movable between said first can storage area and said second can storage area at said rear end thereof, and said other carriage being movable between the second machine and said second can storage area at said head end thereof.

3. The arrangement of claim 1, wherein said first can displacement carriage is arranged to transport a can group comprising a predetermined number of cans with said cans thereof being aligned side-by-side in a direction perpendicular to the direction of transport thereof.

4. The arrangement of claim 3, wherein said second conveyor is configured to transport a said can group with said cans thereof being aligned side-by-side in a direction perpendicular to the direction of transport thereof.

5. The arrangement of claim 3, wherein said predetermined number is four.

6. The arrangement of claim 5, wherein said first conveyor is configured to simultaneously transport six of said can groups.

7. An arrangement for transporting and storing spinning cans between a first machine which fills empty spinning cans and a second machine which empties filled spinning cans, comprising:

a) a first can storage area disposed adjacent the first machine;

b) a second can storage area including, i) a first can conveyor extending between a rear end and a head end of said second can storage area for transport of a filled can only from said rear end to said head end thereof, and ii) a second can conveyor extending between said head end and said rear end of said second can storage area for transport of an empty can only from said head end to said rear end thereof;

c) a first can displacement carriage movable between said first can storage area and said second can storage area for transporting filled cans from said first can storage area to said second can storage area at said rear end thereof, and for transporting empty cans from said second can storage area at said rear end thereof to said first can storage area;

d) a third can storage area disposed adjacent the second machine; and e) a second can displacement carriage movable between said second can storage area and said third can storage area for transporting filled cans from said second can storage area at said head end thereof to said second can storage area, and for transporting empty cans from said third can storage area to said second can storage area at said head end thereof.

8. The arrangement of claim 7, further comprising a can changing carriage movable between said third can storage area and the second machine for supplying the second machine with cans from said third can storage area, said can changing carriage having a storage place for two cans.

9. The arrangement of claim 8, wherein said second can storage area has a capacity for storing more cans than that of said can changing carriage.

10. The arrangement of claim 8, wherein said third can storage area has a capacity for storing more cans than that of said can changing carriage.

11. The arrangement of claim 8, further comprising a fourth supplemental can storage area disposed adjacent the second machine between said can changing carriage and the second machine.

12. The arrangement of claim 7, wherein said second can storage area comprises a plurality of parallel first said conveyors of said second can storage area extending between said rear end and said head end of said second can storage area for transport of filled cans from said rear end to said head end, and a second plurality of parallel second said conveyors of said second can storage area extending between said head end and said rear end of said second can storage area for transport of empty cans from said head end to said rear end, said first can displacement carriage being movable between said first can storage area and said second can storage area at said rear end thereof, and said second can displacement carriage being movable between said third can storage area and said second can storage area at said head end thereof.

13. The arrangement of claim 12, wherein said first can displacement carriage and said second can displacement carriage are each arranged to transport a can group comprising a predetermined number of cans, and wherein said first conveyor is arranged to transport a said can group with said cans thereof being aligned side-by-side in a direction perpendicular to the direction of transport thereof.

14. The arrangement of claim 13, wherein said second conveyor is arranged to transport a said can group with said cans thereof being aligned side-by-side in a direction perpendicular to the direction of transport thereof.

15. The arrangement of claim 13, wherein said predetermined number is four.

16. The arrangement of claim 15, wherein said first conveyor is configured to simultaneously transport six of said can groups.

17. The arrangement of claim 7, wherein said first can storage area includes a capacity for storing at least two cans.

18. The arrangement of claim 7, wherein said second can storage area has a capacity for storing more cans than that of said second can displacement carriage.

19. The arrangement of claim 7, wherein said third can storage area has a capacity for storing more cans than that of said second can displacement carriage.

20. The arrangement of claim 7, wherein said first and second conveyors are inclined to compensate for a height variance between the first and second machines.

21. An arrangement for transporting and storing spinning cans between a first machine which fills empty spinning cans and a second machine which empties filled spinning cans, comprising:

a) a first can storage area disposed adjacent the first machine;

b) a second can storage area including, i) a first can conveyor extending between a rear end and a head end of said second can storage area for transport of a filled can only from said rear end to said head end, and ii) a second can conveyor extending between said head end and said rear end for transport of an empty can only from said head end to said rear end; and c) a can displacement carriage movable between said first can storage area and said second can storage area for transporting filled cans from said first can storage area to said second can storage area at said rear end thereof, and for transporting empty cans from said second can storage area at said rear end thereof to said first can storage area, and movable between said second can storage area and the second machine for transporting filled cans from said second can storage area at said head end thereof to the second machine, and for transporting empty cans from the second machine to said second can storage area at said head end thereof.

22. The arrangement of claim 21, wherein said second storage area comprises a plurality of parallel first said conveyors of said second can storage area extending between said rear end and said head end of said second can storage area for transport of filled cans from said rear end to said head end thereof, and a second plurality of parallel second said conveyors of said second can storage area extending between said head end and said rear end for transport of empty cans from said head end to said rear end, said can displacement carriage being movable between said first can storage area and said first and second series of conveyors, and movable between said first and second series of conveyors and the second machine.

23. The arrangement of claim 21, wherein said can displacement carriage is configured to transport a can group comprising a predetermined number of cans, and wherein said first conveyor is configured to transport a said can group with said cans thereof being aligned side-by-side in a direction perpendicular to the direction of transport thereof.

24. The arrangement of claim 23, wherein said second conveyor is configured to transport a said can group with said cans thereof being aligned side-by-side in a direction perpendicular to the direction of transport thereof.

25. The arrangement of claim 23, wherein said predetermined number is four.

26. The arrangement of claim 25, wherein said first conveyor is configured to simultaneously transport six of said can groups.

27. An arrangement for transporting and storing spinning cans, comprising:

a) first machines which fill empty spinning cans and second machines which empty filled spinning cans, each of said first machines having a first can storage area;

b) a second can storage area including, i) a first can conveyor extending between a rear end and a head end of said second can storage area for transport of a filled can only from said rear end to said head end thereof, and ii) a second can conveyor extending between said head end and said rear end thereof for transport of an empty can only from said head end to said rear end;

c) a first can displacement carriage movable between each said first can storage area and said second can storage area for transporting filled cans from each said first can storage area to said second can storage area at said rear end thereof, and for transporting empty cans from said second can storage area at said rear end thereof to each said first can storage area; and d) a second can displacement carriage movable between said second can storage area and each said second machine for transporting filled cans from said second can storage area at said head end thereof to each said second machine, and for transporting empty cans from each said second machine to said second can storage area at said head end thereof.

28. A method for transporting and storing spinning cans between a first machine which fills empty spinning cans and a second machine which empties filled spinning cans, comprising the steps of:

a) transporting on a first can displacement carriage filled cans from a first can storage area disposed adjacent the first machine to a first can conveyor of a second can storage area that extends between a rear end and a head end of a second can storage area for transport of a filled can only from the rear end to the head end;

b) conveying filled cans from the rear end to the head end of the second can storage area;

c) transporting on a second can displacement carriage filled cans from the second can storage area at the head end thereof to the second machine;

d) transporting on the second can displacement carriage empty cans from the second machine to the second can storage area at the rear end thereof;

e) conveying empty cans from the head end to the rear end; and f) transporting on the first can displacement carriage empty cans from the second can storage area at the head end thereof to the first can storage area.

* * * * *